United States Patent [19]

Yoshino

[11] Patent Number: 4,770,627

[45] Date of Patent: Sep. 13, 1988

[54] COMBUSTION CONTROL SYSTEM FOR OIL BURNER

[75] Inventor: Toru Yoshino, Aichi, Japan

[73] Assignee: Toyotomi Kogyo Co., Ltd., Aichi, Japan

[21] Appl. No.: 945,624

[22] Filed: Dec. 23, 1986

[30] Foreign Application Priority Data

Dec. 24, 1985 [JP] Japan ..... 60-198731[U]

[51] Int. Cl.[4] ..... F23N 1/02

[52] U.S. Cl. ..... 431/18; 431/90; 236/15 BD

[58] Field of Search ..... 431/12, 18, 89, 90; 236/15 BD

[56] References Cited

U.S. PATENT DOCUMENTS

| | | | |
|---|---|---|---|
| 2,000,580 | 5/1935 | Carruthers | 431/12 |
| 3,592,574 | 7/1971 | Zenkner | 431/90 |
| 3,765,824 | 10/1973 | Trozzi | 431/12 X |
| 3,782,881 | 1/1974 | Feeney | 431/90 |
| 3,825,397 | 7/1974 | Johansson et al. | 431/90 X |
| 4,329,138 | 5/1982 | Riordan | 431/90 |
| 4,348,169 | 9/1982 | Swithenbank et al. | 431/89 |
| 4,645,450 | 2/1987 | West | 431/12 |

FOREIGN PATENT DOCUMENTS

| | | | |
|---|---|---|---|
| 0157724 | 12/1981 | Japan | 431/90 |
| 0028922 | 2/1983 | Japan | 431/90 |

*Primary Examiner*—Margaret A. Focarino
*Attorney, Agent, or Firm*—Pollock, Vande Sande & Priddy

[57] ABSTRACT

A combustion control system for an oil burner capable of precisely and positively carrying out adjustment of combustion to accomplish complete combustion during combustion operation when a variation in combustion has been carried out. The combustion control system is constructed to detect the rotation speed of the air fan 34 to detect an actual air feed rate and then determine an appropriate fuel feed rate depending upon the actual air feed rate, so that combustion may be stably and efficiently accomplished.

8 Claims, 4 Drawing Sheets

COMBUSTION CONTROL SYSTEM FOR OIL BURNER

BACKGROUND OF THE INVENTION

1. Field of the Invention

This invention relates to a combustion control system for an oil burner, and more particularly to such a control system which is adapted to control a feed rate of each of fuel and air forcibly supplied to an oil burner to control combustion in the oil burner and a method of controlling combustion in the oil burner.

2. Description of the Prior Art

Conventionally, a variation in combustion in an oil burner has been carried out in a manner to either vary the amount of fuel to be supplied or a fuel feed rate depending upon the amount of air to be supplied or an air feed rate or vary the fuel feed rate depending upon the air feed rate, to thereby accomplish complete combustion in an oil burner. Typical one of such conventional oil burners is disclosed in Japanese Utility Model Publication No. 5180/1967. In the prior art, the amount of one of fuel and air to be supplied with respect to that of the other is merely determined depending upon the amount of actuation of an operation means such as an operation dial. As can be seen from the foregoing, the prior art fails to measure the actual amount of fuel or air being supplied, resulting in a failure in appropriate adjustment of combustion.

SUMMARY OF THE INVENTION

The present invention has been made in view of the foregoing disadvantage of the prior art.

Accordingly, it is an object of the present invention to provide a combustion control system for an oil burner which is capable of readily and precisely accomplishing a desired variation in combustion to constantly ensure complete combustion in the oil burner.

It is another object of the present invention to provide a combustion control system for an oil burner which is capable of precisely and positively carrying out adjustment of combustion to accomplish complete combustion during combustion operation when a variation in combustion has been carried out.

It is a further object of the present invention to provide a method for controlling combustion in an oil burner which is capable of readily and precisely accomplishing a desired variation in combustion to constantly ensure complete combustion in the oil burner.

It is still another object of the present invention to provide a method for controlling combustion in an oil burner which is capable of ensuring precise and positive adjustment of combustion to constantly ensure complete combustion.

In accordance with the present invention, a combustion control system for an oil burner is provided which is adapted to vary a feed rate of each of air and fuel oil supplied to a combustion section of the oil burner to control combustion in the oil burner. The control system comprises a fuel supply means for supplying fuel oil to the combustion section depending upon a fuel control signal, an air supply means for variably supplying air to the combustion section, an air feed rate detecting means for detecting a feed rate of air supplied by means of the air supply means to generate an air feed rate detecting signal corresponding to the air feed rate detected, a fuel feed rate memory means for storing an appropriate fuel feed rate corresponding to the feed rate of air supplied to the combustion section, and a control means for reading the appropriate fuel feed rate from the fuel feed rate memory means depending upon the air feed rate detecting signal generated from the air feed rate detecting means and supplying the fuel control signal to the fuel supply means to supply fuel oil at the fuel feed rate read.

Also, a method of controlling combustion in an oil burner is provided which is adapted to vary a feed rate of each of air and fuel oil supplied to a combustion section of the oil burner to control combustion of the oil burner. The method comprises the steps of detecting a feed rate of air actually supplied to the combustion section and deciding a feed rate of fuel oil supplied to the combustion section depending upon said detected air feed rate actually supplied to the combustion section.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a combustion control system for an oil burner according to the present invention will be described hereinafter with reference to the accompanying drawings.

First, an example of an oil burner in which a combustion control system of the present invention is adapted to be incorporated will be briefly described.

Figure 1:
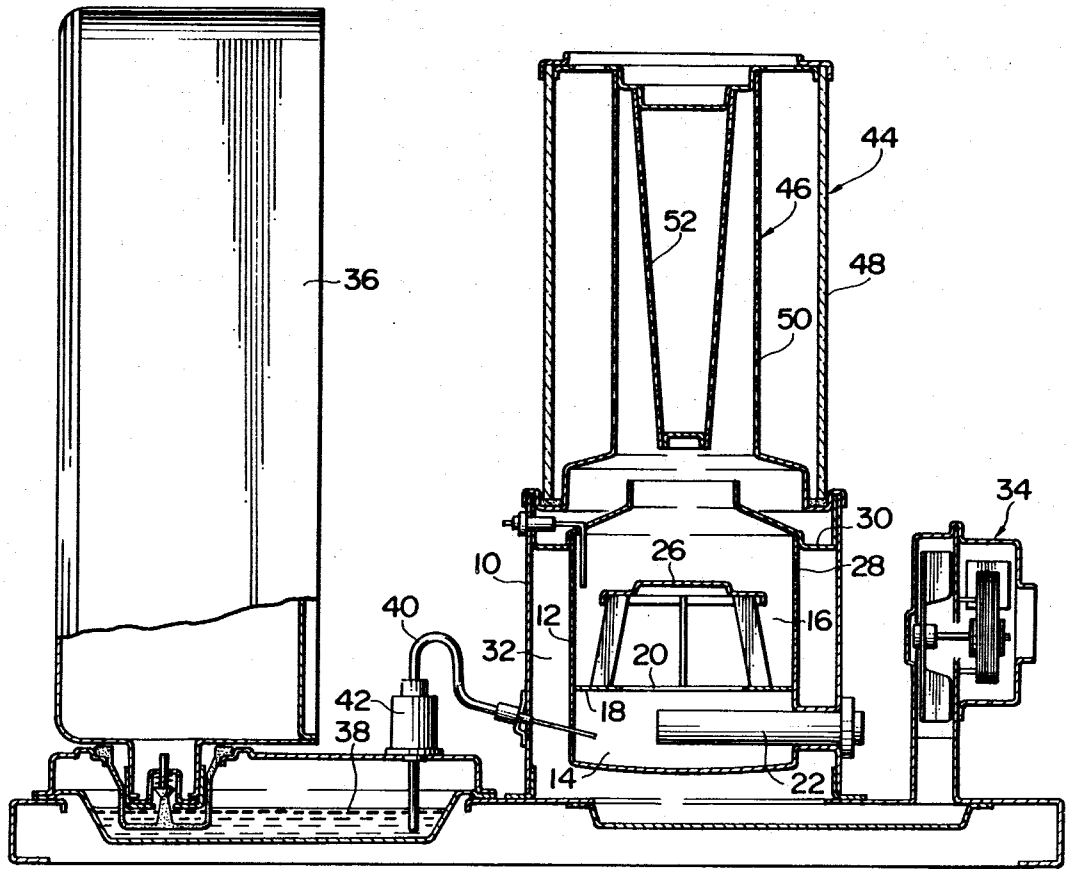
FIG. 1 is a schematic vertical view showing an example of an oil burner in which a combustion control system according to the present invention is adapted to be incorporated.

FIG. 1 shows an example of such an oil burner. An oil burner shown in FIG. 1 is a pot-type oil burner. However, it should be noted that an oil burner to which the present invention is to be applied is not limited to such a pot-type oil burner.

The oil burner of FIG. 1 includes a housing 10 and a combustion section or burner body 12 which is housed in the housing 10 and to which fuel oil and air are supplied to carry out combustion. In the example, the combustion section or burner body 10 is in the form of a pot which is adapted to carry out therein vaporization of fuel oil such as kerosene supplied thereto, and ignition and combustion of vaporized fuel oil. The pot 12 has a lower chamber 14 and an upper chamber 16 formed therein which are separated from each other by a partition 18 having an opening 20 formed at a central portion thereof, through which the chambers 14 and 16 are communicated with each other. The lower chamber 14 has an electric heater 22 arranged therein which acts to heat fuel oil supplied to the pot 12 to vaporize it and ignite the vaporized fuel oil using air supplied from through-holes formed at a side wall of the lower chamber 14. The upper chamber 16 has a plate means 26 arranged therein above the opening 20 and formed into an inverted dish shape to spread flames of fuel oil ignited in the lower chamber and carry out substantial combustion of the vaporized fuel oil using air supplied thereto via a plurality of through-holes 28 formed at a side wall of the upper chamber 16.

In the illustrated example, the combustion section or pot 12 is suspended in the housing 10 by means of an annular top plate 30 which horizontally extends from the pot 12 to the housing 10, so that an annular air supply passage 32 is defined between the housing 10 and the pot 12 to supply combustion air from a fan 34 via through-holes of the pot thereto.

The oil burner also includes an oil tank 36, an oil reservoir 38 and an oil supply pipe 40. Fuel oil is forcibly supplied by means of an electromagnetic pump 42 provided between the oil supply pipe 40 and the oil reservoir 38.

Further, the oil burner includes a multiple combustion cylinder construction 44 supported on the housing 10 in a manner to be communicated with the pot 12. The combustion cylinder construction 44 is adapted to emit heat rays therefrom to ambient. More particularly, the construction 44 includes a red-heated cylinder means 46 and a heat-permeable cylinder 48 arranged to surround the cylinder means 46 with a space being defined therebetween. The cylinder means 46 comprises an outer perforated cylinder 50 and an inner perforated cylinder 52 which are arranged to be concentric with each other.

Figure 2:
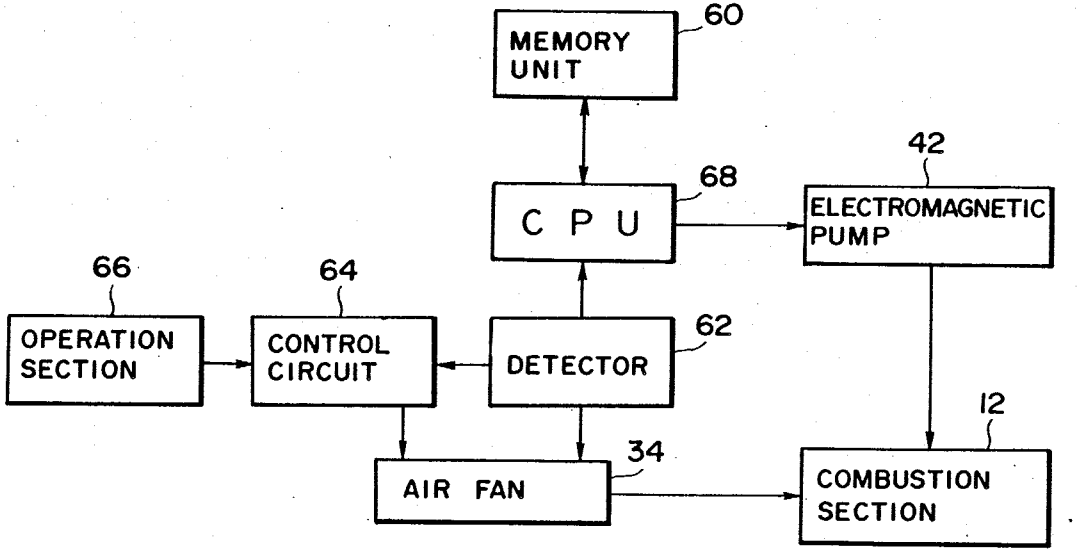
FIG. 2 is a block diagram illustrating an embodiment of a combustion control system for an oil burner according to the present invention.

A combustion control system of the present invention may be incorporated in the oil burner constructed as described above. An embodiment of a combustion control system according to the present invention is shown in FIG. 2. The control system of the illustrated embodiment includes an air supply means which, in the illustrated embodiment, comprises the air fan 34. The air fan 34 is driven by means of an AC motor to supply combustion air to the pot. The AC motor used for the air supply means 34 is not limited to any specific motor so long as it is capable of varying a rotation speed. In general, a single phase induction motor is used as the AC motor.

The combustion system also includes a fuel oil supply means which comprises an electromagnetic pump 42. The electromagnetic pump 42 is controlled by a pump control circuit (not shown). A structure of such an electromagentic pump and the manner of control of the pump are widely known in the art. In the illustrated embodiment, an electromagnetic pump which is constructed in a manner such that a cylinder is actuated every time when one driving pulse is supplied thereto, to thereby discharge a predetermined amount of fuel oil is used for the fuel oil supply means 42.

The supply of electric power to the air fan 34 and the fuel oil supply means including the electromagnetic pump 42, the operation of igniting the oil burner and the operation of setting a safety device are carried out by means of a control switch (not shown). In general, when an air feed rate or the amount of combustion air to be supplied to the pot 12 by means of the air fan 34 is increased, a fuel feed rate or the amount of fuel oil to be supplied thereto must be increased correspondingly.

The combustion control system of the illustrated embodiment also includes a memory unit 60 constituting a fuel feed rate memory means for storing, in the form of a predetermined function or table, a feed rate of fuel oil to be supplied to the combustion section 12 appropriate to a feed rate of air to be supplied to the pot by means of the air fan 34. The memory unit 60 is adapted to store therein an optimum fuel feed rate with respect to a feed rate of air supplied to the pot 12 which is determined by an experiment.

Reference numeral 62 designates a rotation detector which is adapted to detect the number of rotations of a rotary shaft of the motor for the air fan 34 or a rotation speed of the rotary shaft to indirectly detect a feed rate of air supplied to the pot 12 by means of the air fan 34, to thereby generate an air feed rate detecting signal. The rotation speed of the motor of the air fan may be indirectly detected by counting the number of pulse signals supplied from a control circuit described hereinafter to the motor. The detection of the rotation speed itself may be carried out by means of a conventional detector using, for example, an encoder or the like.

The shape of fins of an air fan generally causes a feed rate of air supplied or forced by the air fan to be varied even when the rotation speed is the same. However, it is true that a feed rate of air supplied is proportional to the rotation speed of a motor for the air fan. Accordingly, the detection of rotation speed of the air fan results in an actual feed rate of air supplied to the pot being detected.

The combustion control system of the illustrated embodiment also includes a control circuit 64 for controlling the air fan 34. The control circuit 64 may comprise a phase control circuit which is adapted to change a conducting phase angle of voltage applied across the AC induction motor used for the air fan 34. Alternatively, it may comprise a chopper circuit for controlling a value of the voltage, an inverter circuit adapted to control a frequency of the voltage or the like.

Reference numeral 66 indicates an operation section for supplying a predetermined rotation speed command signal to the control circuit 64. The operation section 66 may be constructed to be manually controlled to generate the rotation speed command signal. Alternatively, it may be constructed to cause the signal to be automatically generated.

The combustion control system of the illustrated embodiment further includes a CPU 68 constituting a control means, which may comprise a microcomputer. The CPU 68 serves to read an appropriate data on a fuel feed rate or the amount of fuel oil to be supplied to the pot 12 from the memory unit 60 depending upon an air feed rate detecting signal generated from the rotation detector 62 and then supply to the electromagnetic pump or fuel supply means 42 a fuel control signal to ensure the supply of fuel oil at the read fuel feed rate.

The CPU 68 computes the number of driving pulses per unit time or a frequency of the driving pulse to be supplied to the electromagnetic pump 42 depending upon the fuel feed rate data read from the memory unit 60. The computation of the driving pulse number is suitably carried out depending upon characteristics of the electromagnetic pump 42 used. For example, it may be carried out in a manner to previously store a frequency of a driving pulse corresponding to a fuel feed rate in the form of a table in a memory of the microcomputer and suitably decide an appropriate frequency of the driving pulse based on the table. Thus, the fuel control signal is supplied to the electromagnetic pump 42 of the fuel supply means to cause fuel oil to be supplied to the combustion section 12 at a feed rate corresponding to an air feed rate.

Figure 3:
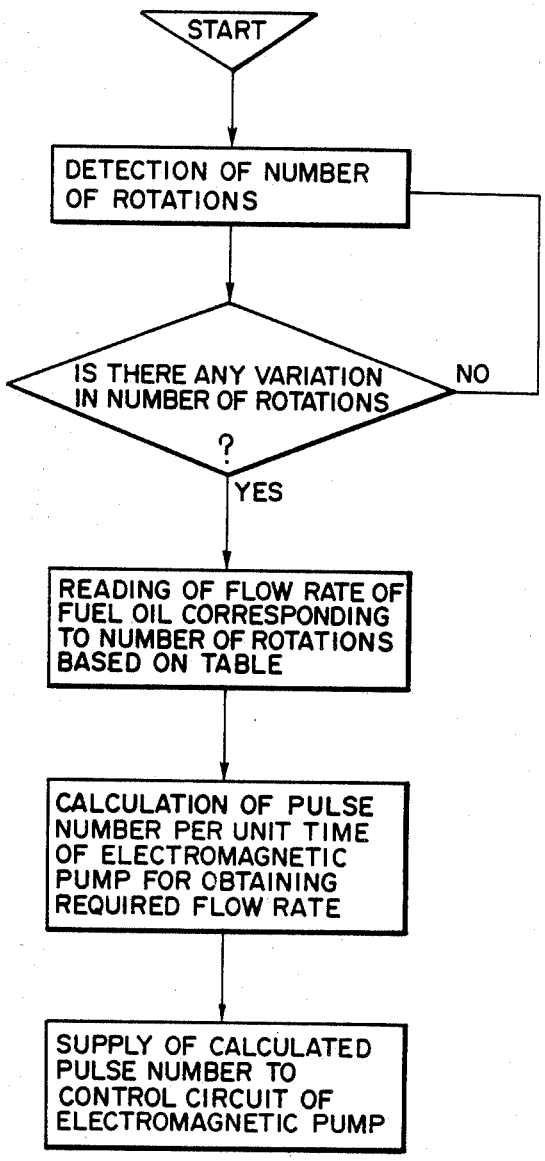
FIG. 3 is a flow chart showing an example of processing by a CPU used in the embodiment shown in FIG. 2.

Now, an example of processing carried out in the CPU will be described with reference to FIG. 3.

First, the CPU 68 causes the rotation detector 62 to detect a rotation speed of the motor for the air fan 34. When there is any difference between the so-detected rotation speed and a reference or previously detected rotation speed, the CPU reads a fuel supply rate corresponding to the rotation speed from the table stored in the memory unit 60 and then computes the number of driving pulses which are to be supplied to the electromagnetic pump 42 for obtaining a required fuel supply rate. Upon computation, the CPU supplies a fuel control signal indicating the driving pulse number to the control circuit of the electromagnetic pump and then returns to the start. The processing shown in the flow chart of FIG. 2 is one of examples, accordingly, the illustrated embodiment is not limited to such processing.

Now, the manner of operation of the illustrated embodiment shown in FIG. 2 will be described hereinafter.

A start switch (not shown) is actuated to start the supply of electric power to the air fan 34, the fuel supply means including the electromagnetic pump 42, and the like from a power supply (not shown).

The operation section 66 generates a rotation speed command signal for setting a rotation speed of the motor for the air fan 34. In the illustrated embodiment wherein the air fan control circuit 64 comprises a phase control circuit, the control circuit 64 controls a conducting phase angle of voltage supplied to the motor of the air fan 34 depending upon the signal from the operation section 66, so that the motor may be driven by means of the voltage controlled by the control circuit 64. When the air fan 34 is rotated, air is applied to the combustion section 12 at a feed rate substantially proportional to the rotation speed of the motor.

The rotation detector 62 detects the rotation speed of the motor of the air fan 2 at a predetermined cycle and supplies to the CPU 68 an air feed rate detecting signal corresponding to the rotation speed. The CPU 68 reads an appropriate fuel feed rate from the table stored in the memory unit 60 depending upon the fuel feed rate detecting signal. Then, the CPU 68 computes the number of driving pulses per unit time or a frequency of the pulse and supplies a fuel control signal representing the number of pulses computed to the fuel control means including the electromagnetic pump 42. Such operation is repeated.

As described above, the illustrated embodiment is constructed to detect the rotation speed of the air fan 34 to detect an actual air feed rate and then determine an appropriate fuel feed rate depending upon the actual air feed rate, so that combustion may be stably and efficiently accomplished.

In the illustrated embodiment, the air feed rate is detected based on the rotation speed of the motor of the air fan 34. However, the detection may be carried out using another means such as, for example, an air feed pressure detecting device for detecting an air feed pressure or a pressure under which air is supplied to the pot 12 to detect the air feed rate. The air feed pressure may be detected in a manner to arrange a thermistor in the air supply passage 32 of the oil burner which is used for, for example, detecting a variation in temperature and detect a variation in resistance of the thermistor due to cooling of the thermistor by air, to thereby detect a variation of the air feed pressure.

Figure 4:
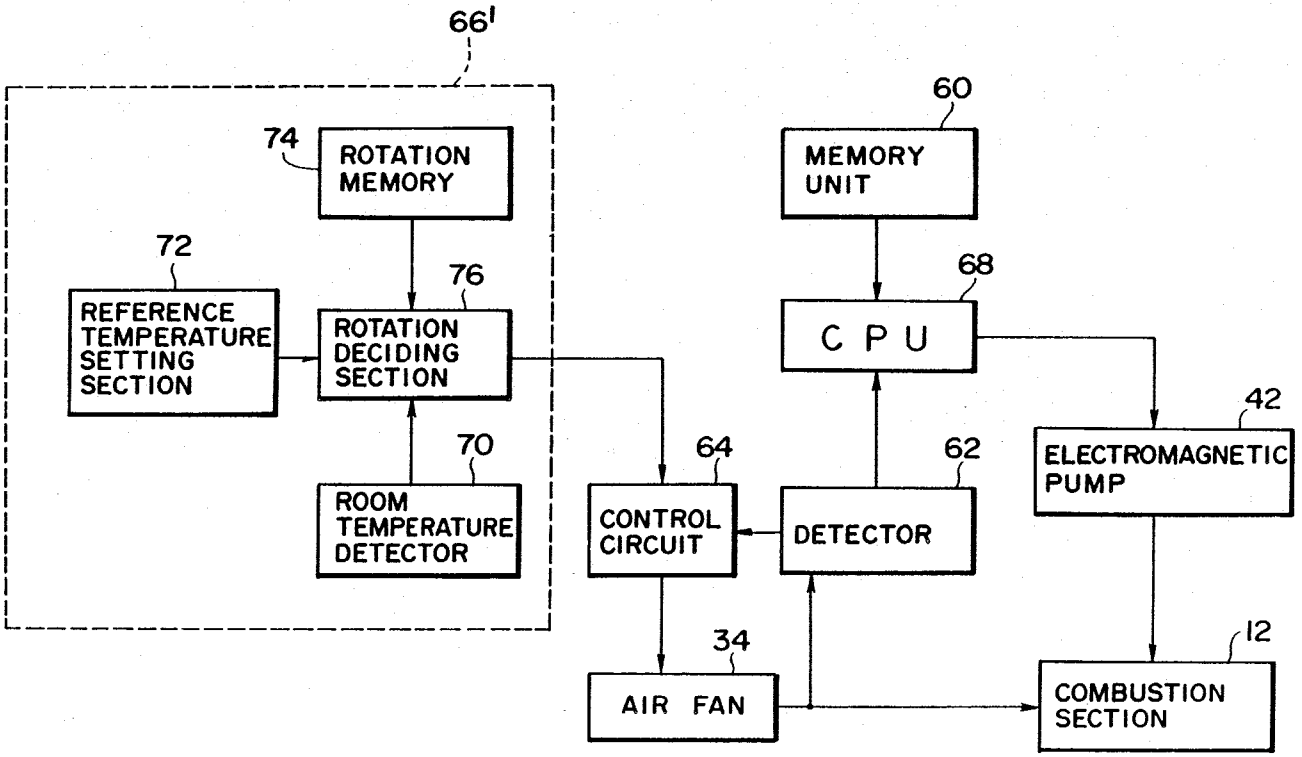
FIG. 4 is a block diagram showing another embodiment of a combustion control system for an oil burner according to the present invention.

FIG. 4 shows another embodiment of the present invention. In the illustrated embodiment, an air feed rate operation section 66' which is adapted to automatically generate a rotation speed command signal is substituted for the operation section 66 in the above-described embodiment. The operation section 66' comprises a room temperature detector 70 for measuring a temperature of a room in which the oil burner is placed, a reference temperature setting section 72 for setting a reference temperature, a rotation memory 74 for storing a rotation speed of an air fan so that a room temperature may appropriately approach to a reference temperature set at the section 72 when there is a difference between the room temperature and the reference temperature, and a rotation deciding section 76 for detecting a difference between a room temperature detected at the room temperature detector 70 and a reference temperature set at the reference temperature setting section 72 to read an appropriate rotation speed of the air fan 34 from the rotation memory. In the embodiment, the rotation deciding section 76 is independently provided. However, the embodiment may be constructed to cause the CPU 68 to carry out function of the rotation deciding section 76 as well as its own function to eliminate it.

The remaining part of the embodiment may be constructed in substantially the same manner as that shown in FIG. 2.

The air feed rate operation section 66' constructed as described above appropriately sets a rotation speed of a motor for the air fan 34 depending upon a variation in a room temperature so as to cause the room temperature to approach to a reference temperature, so that an appropriate fuel feed rate may be decided depending a variation in a room temperature.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise as specifically described.

What is claimed is:

1. A combustion control system for an oil burner which is adapted to vary a feed rate of both air and fuel oil supplied to a combustion section of the oil burner, comprising:

a fuel supply means for supplying fuel oil to said combustion section depending upon a fuel control signal;

an air supply means for variably supplying air to said combustion section;

an air feed rate detecting means for detecting a feed rate of air supplied by said air supply means to generate an air feed rate signal corresponding to said air feed rate detected;

a fuel feed rate memory means for storing optimum fuel feed rate values corresponding to feed rate values of air supplied to said combustion section; and a control means for receiving said air feed rate signal generated by said air feed rate detecting means and for generating said fuel control signal in response to an optimum value of a fuel feed rate selected from said memory as corresponding to said air feed rate signal, said control means supplying said fuel control signal to said fuel supply means to supply fuel oil at said optimum fuel feed rate value.

2. A combustion control system as defined in claim 1, wherein said air supply means comprises:

a motor for air supply;

an air feed rate operation section for selecting a feed rate of air;

a control circuit for controlling rotation speed varying factors, such as voltage, power, phase, frequency or the like to control a rotation speed of said motor depending upon an operation signal supplied from said air feed rate operation section.

3. A combustion control system as defined in claim 2, wherein said motor comprises an AC motor and said control circuit comprises a phase control circuit for controlling a conducting phase angle of voltage applied across said AC motor.

4. A combustion control system as defined in claim 2, wherein said air feed rate operation section includes a room temperature detector for detecting a temperature of a room in which said oil burner is placed and a reference temperature setting section for setting a reference temperature so that said air feed rate may be selected depending upon a difference between said room temperature detected and said reference temperature.

5. A combustion control system as defined in claim 1, wherein said air feed rate detecting means comprises a rotation speed detector for detecting a rotation speed of an output shaft of said motor.

6. A combustion control system as defined in claim 1, wherein said air feed rate detecting means comprises an air feed pressure detector for detecting pressure of air supplied by said air supply means.

7. A combustion control system as defined in claim 1, wherein said fuel feed rate memory means and said control means comprise a memory section and a CPU of a microcomputer, respectively.

8. A combustion control system as defined in claim 1, wherein said fuel supply means comprises an electromagnetic pump actuated by said fuel control signal generated from said control means.

* * * * *